US011752059B2

(12) United States Patent
Taivainen et al.

(10) Patent No.: US 11,752,059 B2
(45) Date of Patent: Sep. 12, 2023

(54) REHABILITATION DEVICE AND ITS USE FOR EXERCISING THE SHOULDER REGION

(71) Applicant: David Health Solutions Ltd., Helsinki (FI)

(72) Inventors: Tapio Taivainen, Outokumpu (FI); Jaakko Tuononen, Outokumpu (FI); Johannes Hautamäki, Espoo (FI)

(73) Assignee: David Health Solutions Ltd., Helsinki (FI)

( * ) Notice: Subject to any disclaimer, the term of this patent is extended or adjusted under 35 U.S.C. 154(b) by 356 days.

(21) Appl. No.: 16/647,487

(22) PCT Filed: Sep. 11, 2018

(86) PCT No.: PCT/FI2018/050645
§ 371 (c)(1),
(2) Date: Mar. 14, 2020

(87) PCT Pub. No.: WO2019/053325
PCT Pub. Date: Mar. 21, 2019

(65) Prior Publication Data

US 2020/0214922 A1 Jul. 9, 2020

(30) Foreign Application Priority Data

Sep. 15, 2017 (FI) ..... 20175820

(51) Int. Cl.
*A61H 1/02* (2006.01)

(52) U.S. Cl.
CPC ... *A61H 1/0281* (2013.01); *A61H 2201/0196* (2013.01); *A61H 2201/1207* (2013.01);
(Continued)

(58) Field of Classification Search
CPC ..... A61H 1/0281; A61H 2201/0196; A61H 2201/1207; A61H 2201/149;
(Continued)

(56) References Cited

U.S. PATENT DOCUMENTS 5,179,939 A * 1/1993 Donovan ..... A61H 1/0281 482/4
5,417,643 A * 5/1995 Taylor ..... A61H 1/0274 601/24
5,437,589 A * 8/1995 Habing ..... A63B 23/03541 482/136
5,897,467 A * 4/1999 Habing ..... A63B 21/4035 482/142
5,916,072 A 6/1999 Webber
(Continued)

FOREIGN PATENT DOCUMENTS

FI 126770 B 5/2017

*Primary Examiner* — Garrett K Atkinson
(74) *Attorney, Agent, or Firm* — Edwin A. Sisson, Attorney at Law, LLC; Jeffrey J. Banyas

(57) ABSTRACT

The invention relates to a rehabilitation device adapted for rehabilitation and/or exercise of the shoulder region, the device being provided with a frame (1), which is connected to a power-generating apparatus (2), a back part (10), a seat part (11), and armrests (21). The rehabilitation device according to the invention is characterised in that it further comprises first support arms (23), second support arms (24), and motion arms (22), which communicate with said corresponding first and second support arms. The rehabilitation device according to the invention is further characterised in that said armrests (21) are articulated in said corresponding motion arms (22), and said power-generating apparatus (2) communicates with said motion arms (22). In addition, the invention relates to the use of the rehabilitation device for exercising the shoulder region.

19 Claims, 16 Drawing Sheets

(52) U.S. Cl.
CPC ..... *A61H 2201/149* (2013.01); *A61H 2201/1623* (2013.01); *A61H 2201/1633* (2013.01); *A61H 2201/1635* (2013.01); *A61H 2201/5069* (2013.01); *A61H 2203/0431* (2013.01)

(58) Field of Classification Search
CPC .... A61H 2201/1623; A61H 2201/1633; A61H 2201/1635; A61H 2201/5069; A61H 2203/0431; A61H 2201/0173; A61H 2201/14; A61H 2201/1676; A61H 2201/501; A61H 2205/062; A61H 1/02; A63B 21/00178; A63B 21/00181; A63B 21/0023; A63B 21/154; A63B 21/4035; A63B 21/4047; A63B 23/1245; A63B 23/1254; A63B 23/1263; A63B 23/1272; A63B 24/0087; A63B 21/4039; A63B 2024/0093; A63B 2071/0072; A63B 2208/0233; A63B 2220/24; A63B 2220/51; A63B 2225/20; A63B 2225/50; A63B 23/1209; A63B 21/00; A63B 21/068; A63B 23/12
See application file for complete search history.

(56) References Cited

U.S. PATENT DOCUMENTS

| | | | | | |
|---|---|---|---|---|---|
| 6,071,216 | A * | 6/2000 | Giannelli | A63B 21/4035 | 482/136 |
| 6,142,917 | A * | 11/2000 | Giannelli | A63B 23/1209 | 482/136 |
| 6,254,516 | B1 * | 7/2001 | Giannelli | A63B 23/1209 | 482/136 |
| 6,287,243 | B1 * | 9/2001 | Isom | A63B 21/078 | 482/130 |
| 7,364,535 | B1 * | 4/2008 | Rosenow | A63B 21/4033 | 482/142 |
| D613,350 | S * | 4/2010 | Fenster | D21/675 | |
| 7,717,836 | B1 * | 5/2010 | Miller | A63B 21/00 | 482/142 |
| 7,833,138 | B1 * | 11/2010 | Fulks | A63B 23/12 | 482/136 |
| 2003/0092543 | A1 * | 5/2003 | Giannelli | A63B 21/4035 | 482/99 |
| 2005/0032614 | A1 * | 2/2005 | Keiser | A63B 21/4029 | 482/142 |
| 2008/0300511 | A1 | 12/2008 | Binns et al. | | |
| 2014/0194260 | A1 | 7/2014 | Campanaro et al. | | |
| 2015/0273269 | A1 | 10/2015 | Chen | | |
| 2015/0360069 | A1 | 12/2015 | Marti et al. | | |

* cited by examiner

REHABILITATION DEVICE AND ITS USE FOR EXERCISING THE SHOULDER REGION

FIELD OF THE INVENTION

The present invention relates to a device adapted for rehabilitating and/or exercising the shoulder region in order to prevent, alleviate and/or cure pains in the shoulder region.

DESCRIPTION OF RELATED ART

Shoulder pain is a formidable problem worldwide. Of all musculoskeletal problems, shoulder ailments cause the most sick leave absences. Shoulder pain is the most common musculoskeletal ailment in persons over 65 years of age and its prevalence has tripled during the last 40 years. One in every two persons will experience shoulder pains during their lifetime. In spite of these figures, rehabilitating and exercising the shoulder measurably, monitorably and repeatably by a biomechanically optimal method has not been possible.

Devices conceived for strengthening the muscles in the shoulder and the shoulder region are typically intended primarily for strengthening the big muscles that give motion to the upper limbs. Nevertheless, the causes of shoulder problems and pains usually lie elsewhere. In most cases, such problems are caused by weakness of the small muscles supporting the shoulder joint and the muscles moving and stabilising the shoulder blade. Consequently, conventional fitness training apparatus is not appropriate for exercising these muscles.

From US2008/0300511 A1 is prior known a shoulder strength exercising device, which allows for inner and outer rotation of both shoulders.

In addition, US2014/0194260 A1 discloses a method for using an exercising device with adjustable angles.

The rotator cuff consists of four muscles, of which only one, subscapularis, rotates the upper arm inwards. Supraspinatus, infraspinatus and teres minor rotate the upper arm outwards. From FI126770 B is prior known a rehabilitating device for exercising the rotator cuff.

Serratus anterior, i.e. the anterior serratus muscle, gives the shoulder blade versatile motion and stabilisation. There is no prior art device especially intended for exercise of this anterior serratus muscle.

In physiotherapy, the anterior serratus muscle is trained by means of an exercise motion of reaching out with the hand. At the initial rehabilitation stage, a so-called shoulder-blade push-up, performed with one hand or both hands simultaneously, is a typical exercise. The exercise is performed with one or both hands straight leaning against the wall while pushing the body away from the wall. In this case, only the shoulder blade is given motion. In the process of rehabilitation, the angle between the wall and the body is increased and the exercise requires more physical effort. At the final stage, the exercise is performed against the floor with the body in nearly horizontal position.

A second option of performing the exercise involves the use of various kinds of resistance instead of one's own body weight. When lying on one's back, one can use, for instance, a bar or dumbbells. In a standing or sitting position, one can use e.g. a rubber string, various pulleys or chest press devices.

The anterior serratus muscle can be efficiently activated with these exercises, provided that they are carried out correctly. However, problems arise when the shoulder hurts, the muscles to be exercised are weak and the shoulder blade control is inadequate on the whole. In such cases, the motion will inevitably be out of complete control and this particular muscle of interest will not be sufficiently activated.

BRIEF SUMMARY OF THE INVENTION

The purpose of the invention is to provide a device allowing exercise of the shoulder which activates the anterior serratus muscle efficiently, while the motion is performed under control so as to be correct under all circumstances.

This purpose is achieved with the device defined in independent claim 1 and with the use defined in independent claim 10. Preferred embodiments of the invention are defined in the dependent claims.

The present invention relates to a rehabilitation device, which is adapted for rehabilitation and/or exercise of the shoulder region, the device being provided with a frame 1 connected to a power-generating apparatus 2, a back part 10, a seat part 11 and armrests 21. The rehabilitation device according to the invention is characterised in comprising additionally first support arms 23, second support arms 24 and motion arms 22, which communicate with said corresponding first and second support arms. The rehabilitation device according to the invention is further characterised in said support arms 21 being articulated on said corresponding motion arms 22 and said power-generating apparatus communicating with said motion arms 22.

In one preferred embodiment of the invention, each armrest 21 in the rehabilitation device is movable supported by the corresponding motion arm 22 and the corresponding support arms 23, 24 over a predetermined trajectory. Said trajectory may further pass from the rest position to the extreme position and vice versa.

In a second preferred embodiment of the invention, the armrests 21 of the rehabilitation device can be moved synchronously or asynchronously relative to each other.

In a further preferred embodiment of the invention, the power-generating apparatus 2 of the rehabilitation device comprises a pulley 31, which can be put in motion so as to vary the power generated for the parts of the rehabilitation device.

In addition, the rehabilitation device may be provided with means for transmitting stored data to the apparatus, and also means for automatic adjustment of at least one of the following on the basis of stored data: the armrests 21, the motion arms 22, the support arms 23, 24, the back part 10, the seat part 11, the power-generating apparatus 2, and other parts. These data may be stored in a cloud service and/or contain the personal data of each user for adjusting the device.

The rehabilitation device according to the invention is preferably adapted to activate especially the anterior serratus muscle (m. serratus anterior).

The rehabilitation device according to the invention may be provided with means for performing isometric measurements.

The present invention further relates to the use of the rehabilitation device described above for exercising the shoulder region. The use of the rehabilitation device according to the invention is characterised in that the user positions the arms in the armrests 21 and moves one or both arms between the rest position and the extreme position over a predetermined trajectory while the armrests 21 support the user's arms so as to minimise the activation supporting the upper part of the trapezius muscle.

BRIEF DESCRIPTION OF THE DRAWINGS

Preferred embodiments of the invention are shown in greater detail by means of the accompanying drawings, in which.

DETAILED DESCRIPTION OF THE INVENTION

Figure 1A:
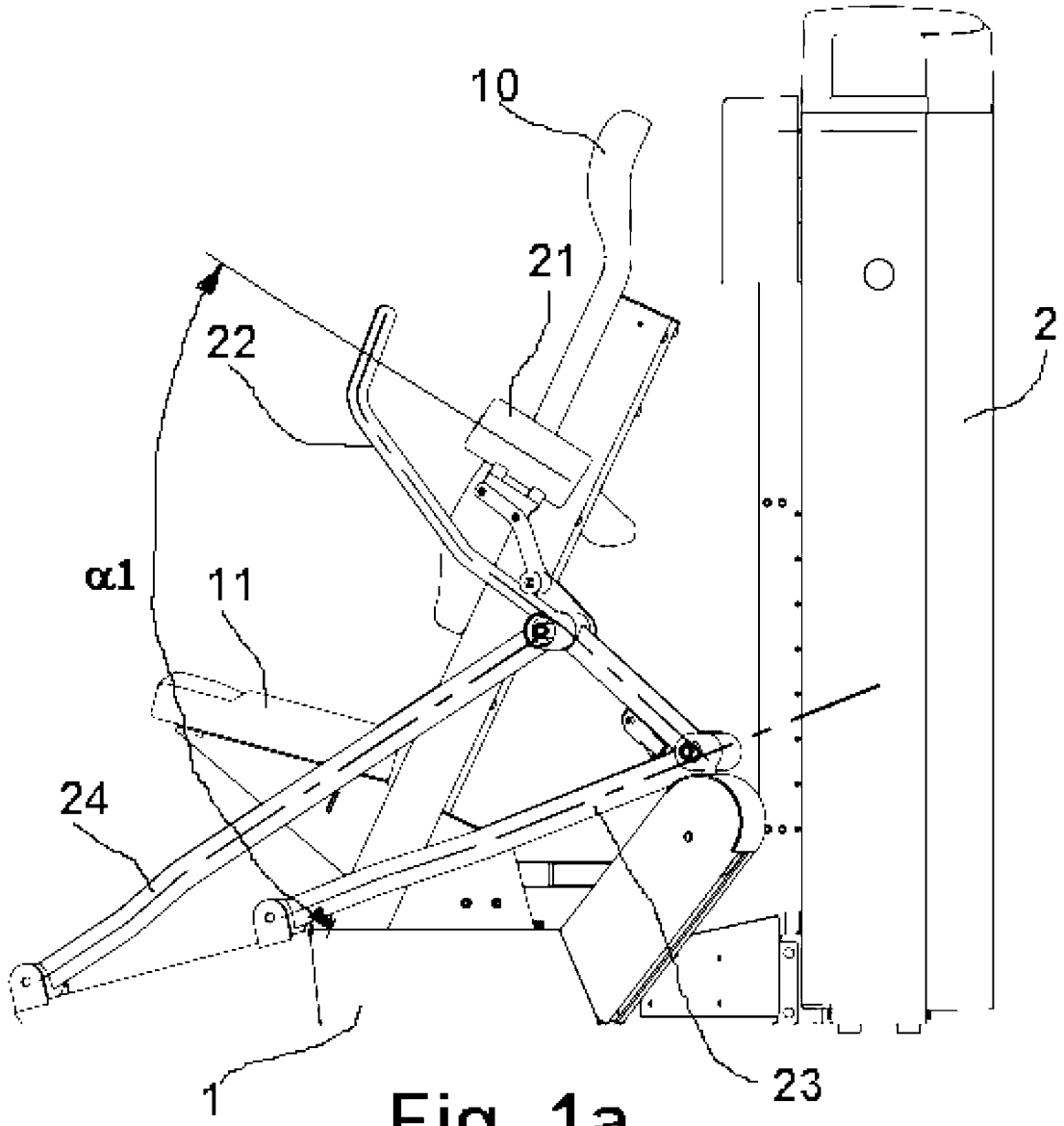
FIG. 1*a* shows a right-hand lateral view of the device according to the invention in the rest position.
Figure 1B:
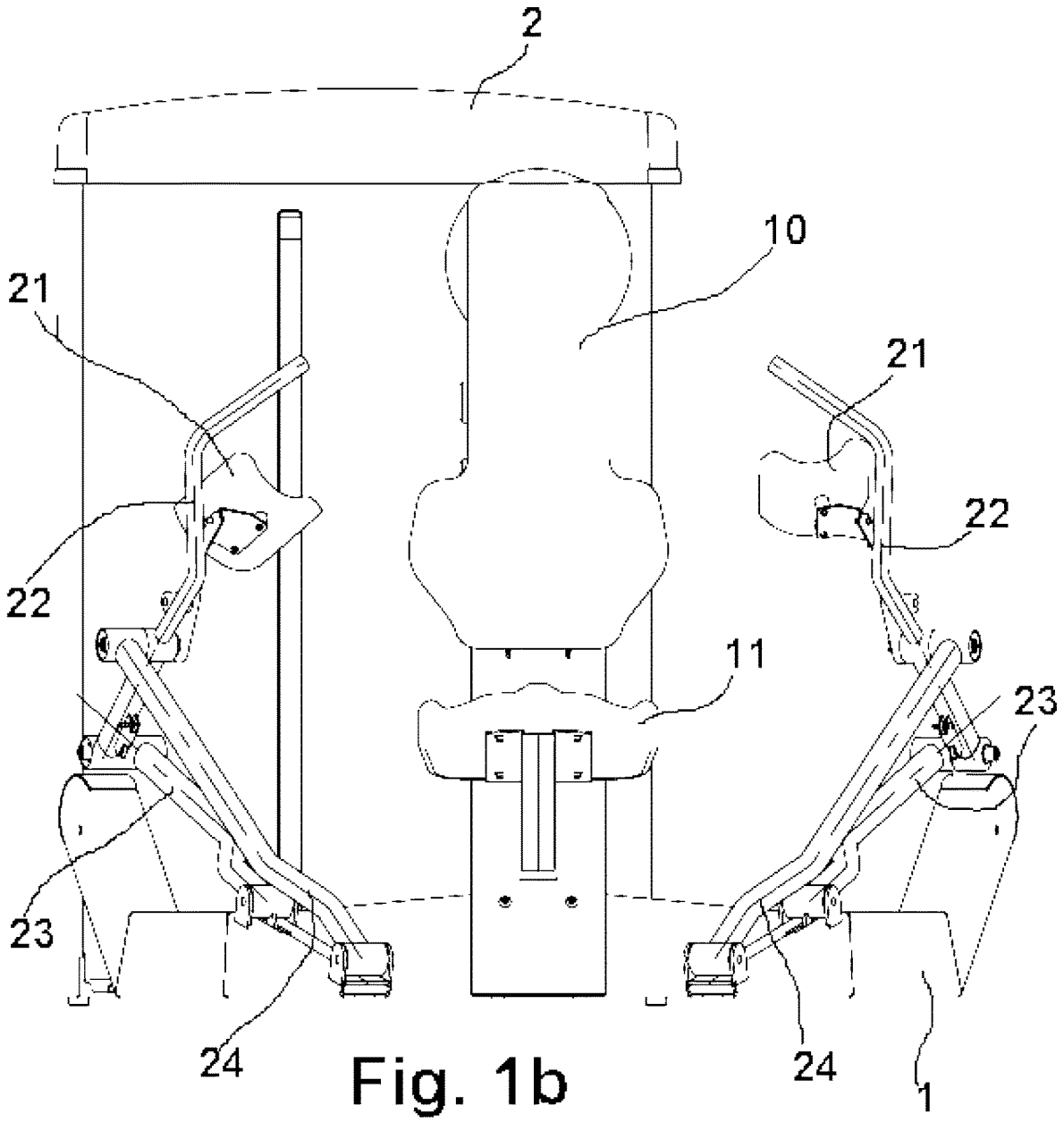
FIG. 1*b* shows a front view of the device according to the invention in the rest position.
Figure 1C:
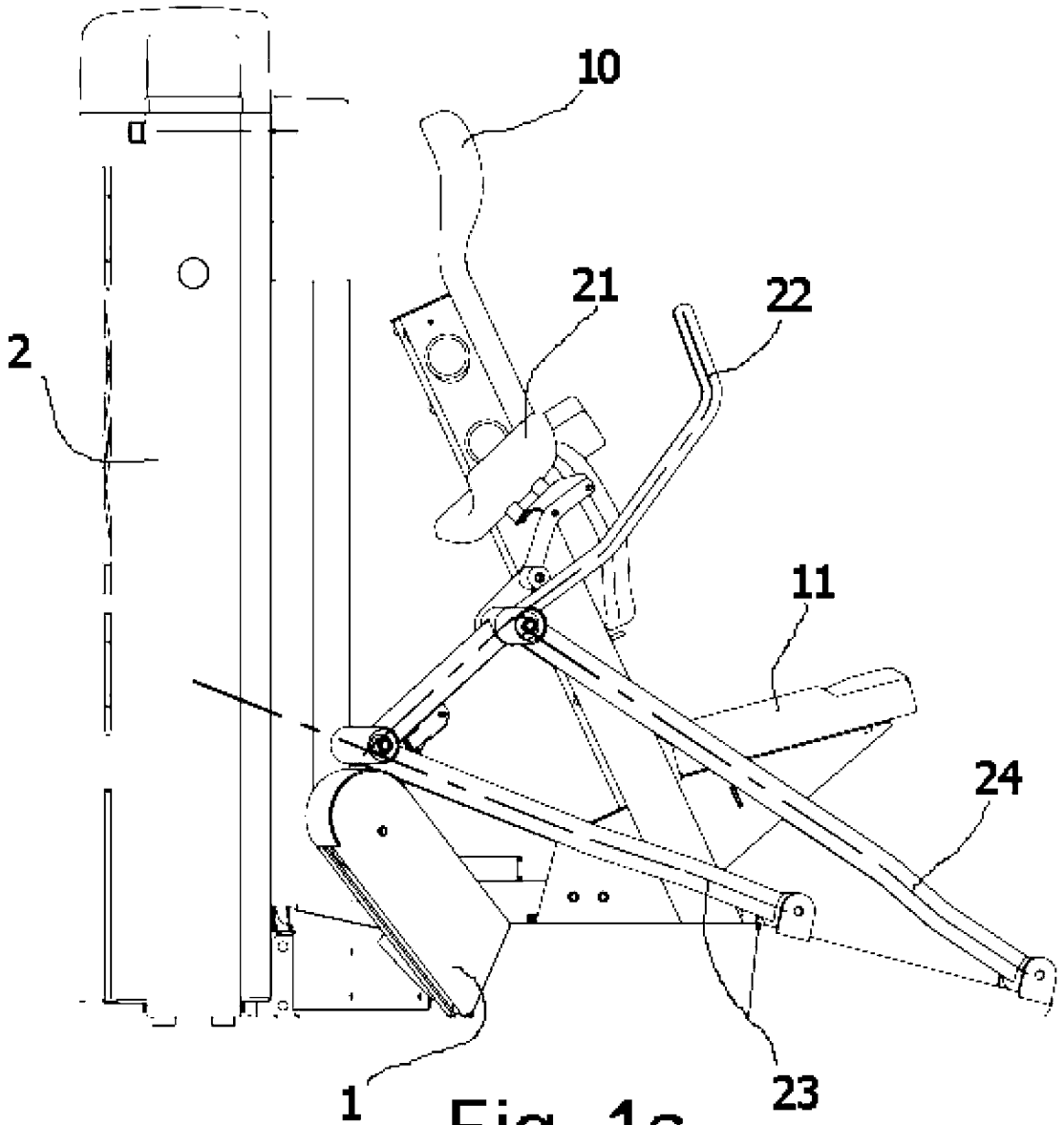
FIG. 1*c* shows a left-hand lateral view of the device according to the invention in the rest position.
Figure 1D:
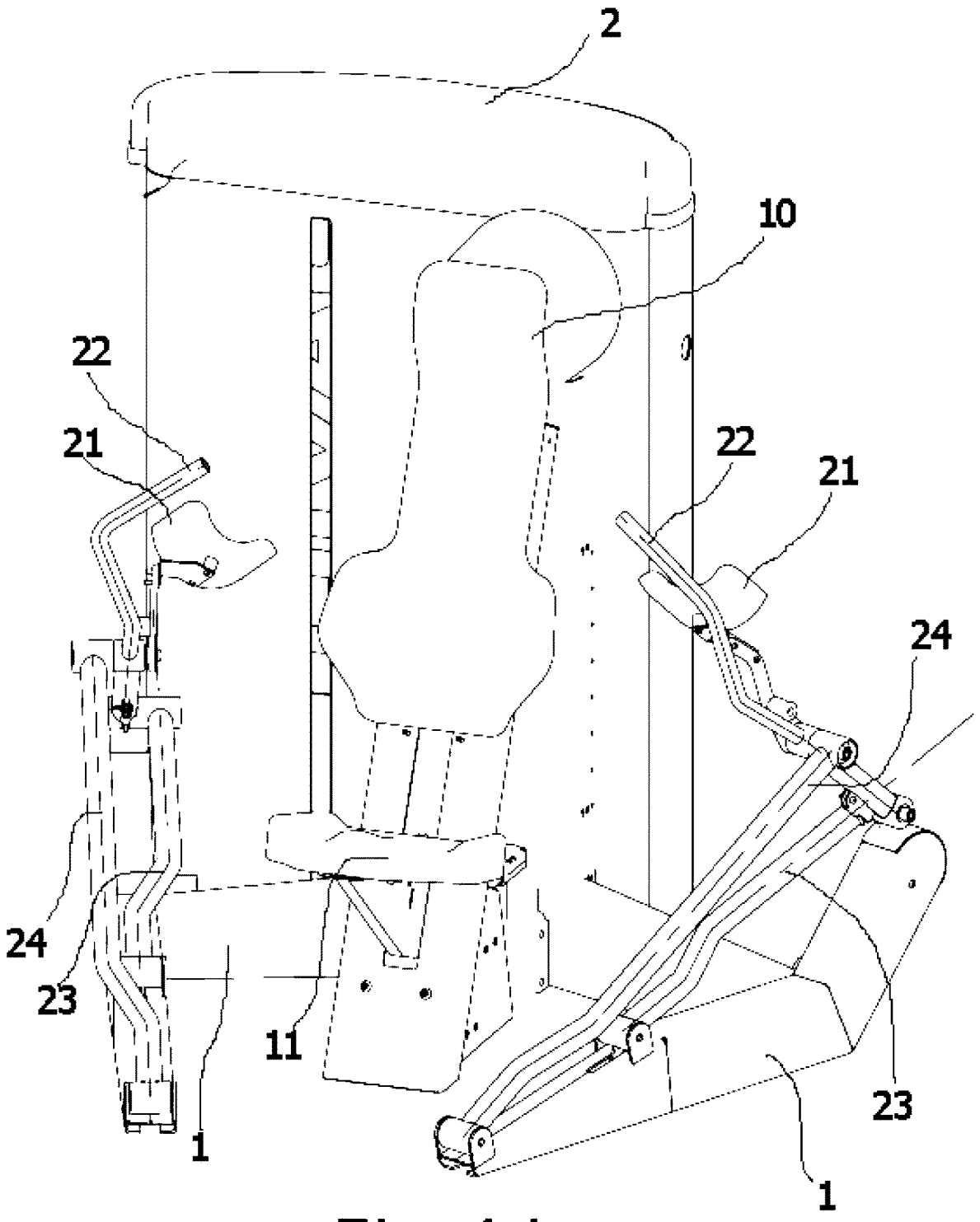
FIG. 1*d* shows a first illustrative drawing of the device according to the invention in the rest position.
Figure 1E:
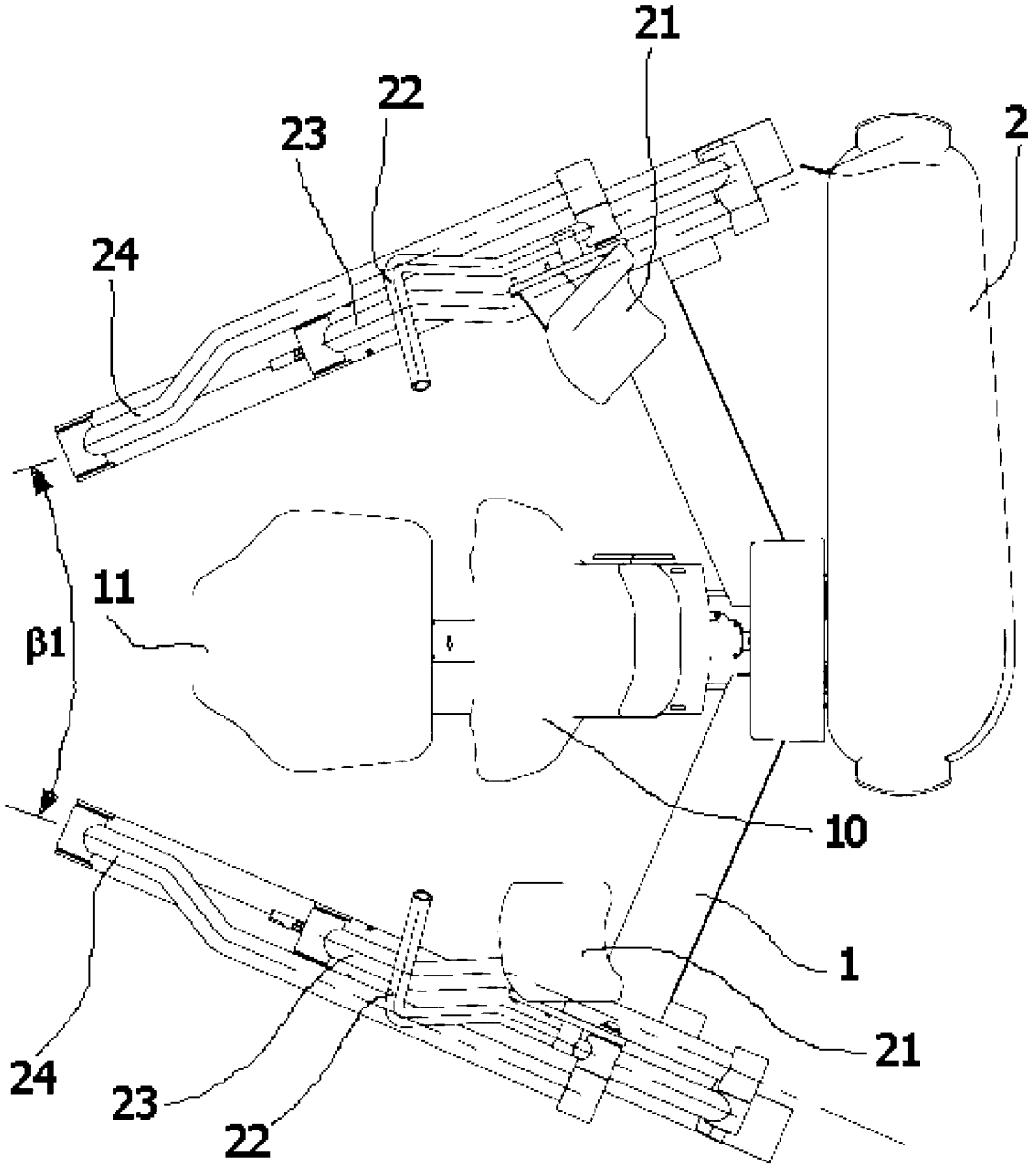
FIG. 1*e* shows a top view of the device according to the invention in the rest position.
Figure 1F:
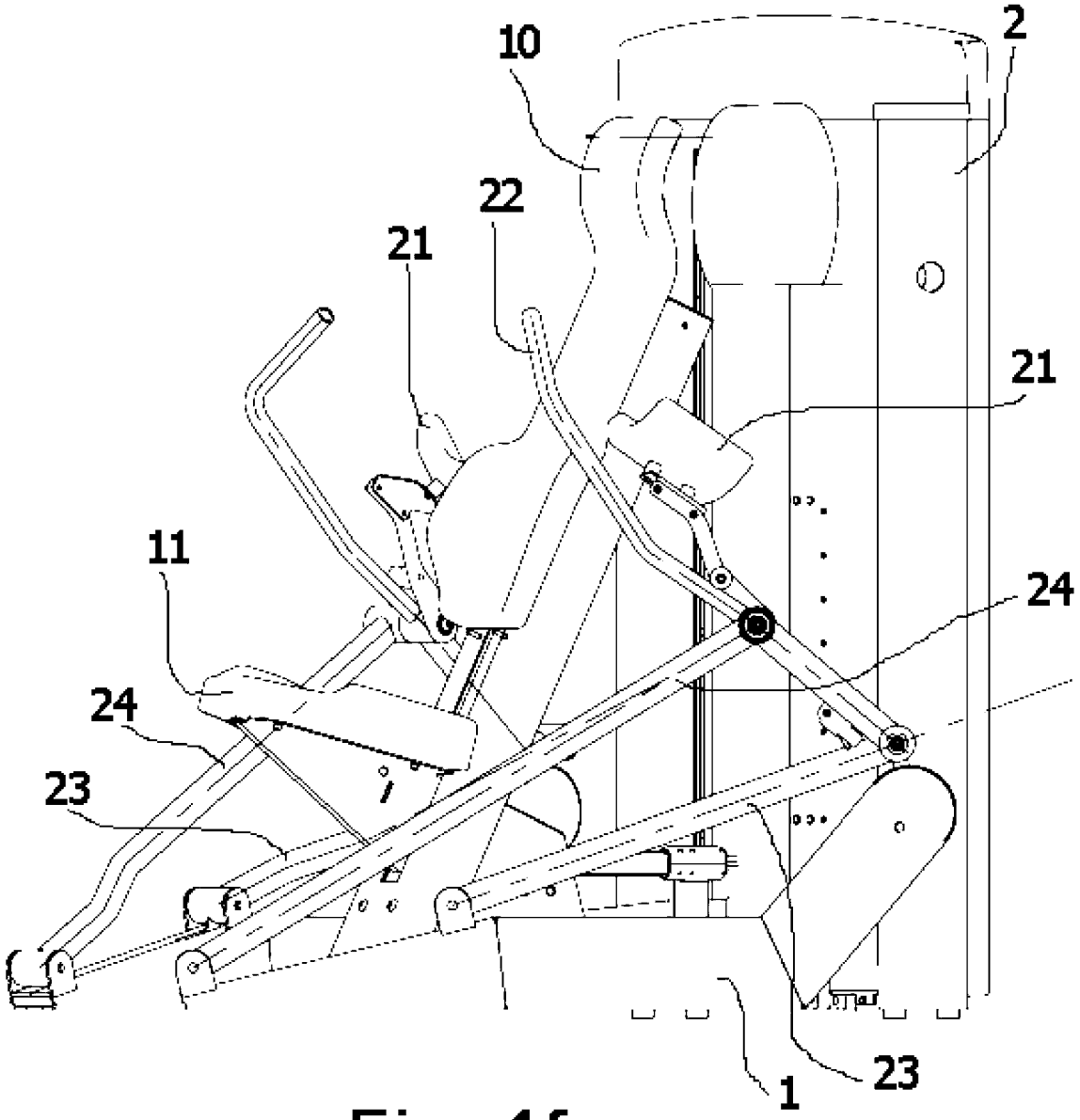
FIG. 1*f* shows a second illustrative drawing of the device according to the invention in the rest position.

FIGS. 1*a*-1*f* show the rehabilitation device according to the invention in the rest position. The back part 10 and the seat part 11 form the seat frame, on which the user is seated. On both sides of the seat frame, there are units supporting the user's arms and consisting of two support arms 23, 24, one motion arm 22 and armrests 21. The support arms 23, 24 are connected with the frame 1 of the device.

Figure 2A:
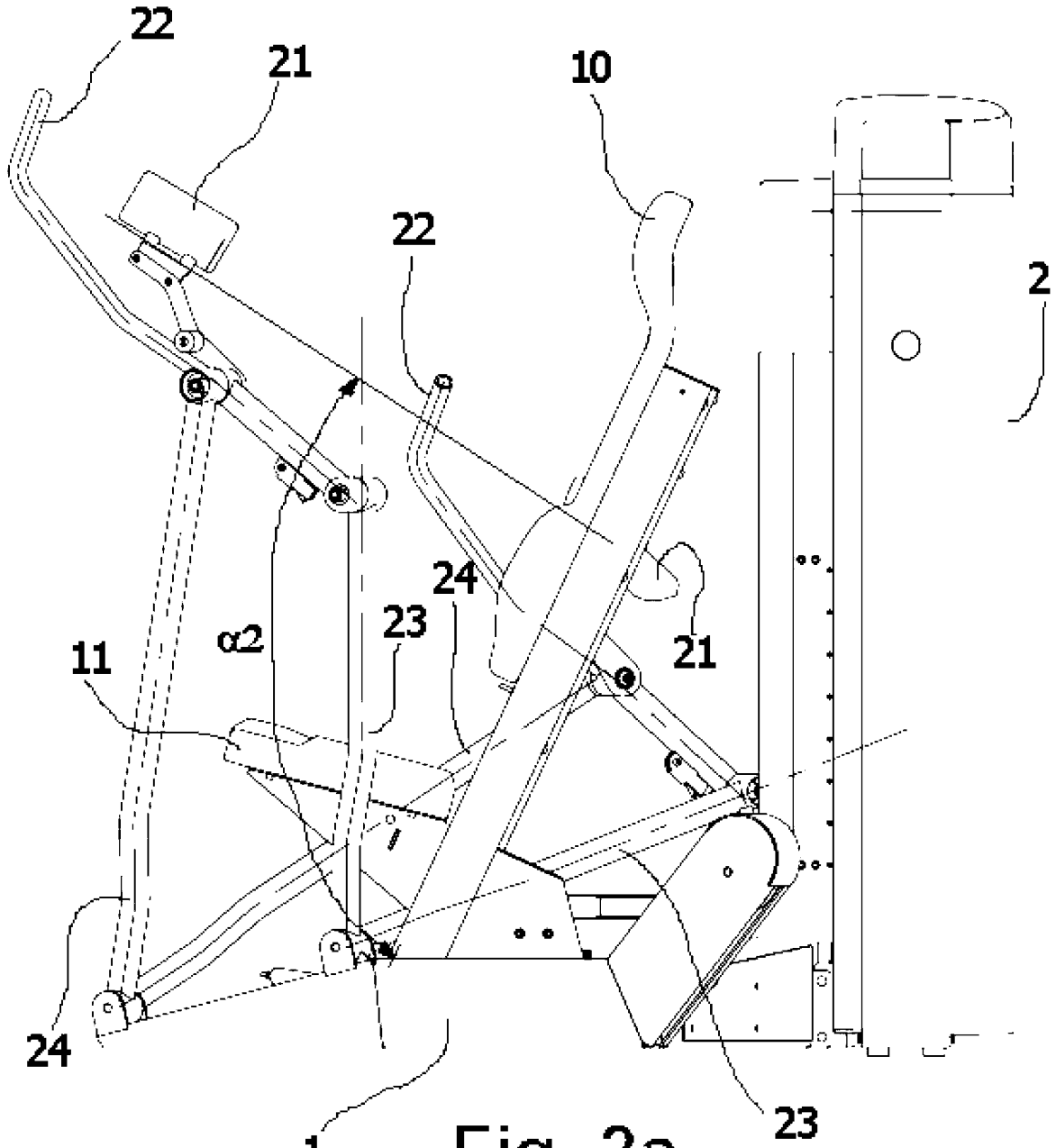
FIG. 2*a* shows a right-hand lateral view of the device according to the invention in the extreme position of the left hand.
Figure 2B:
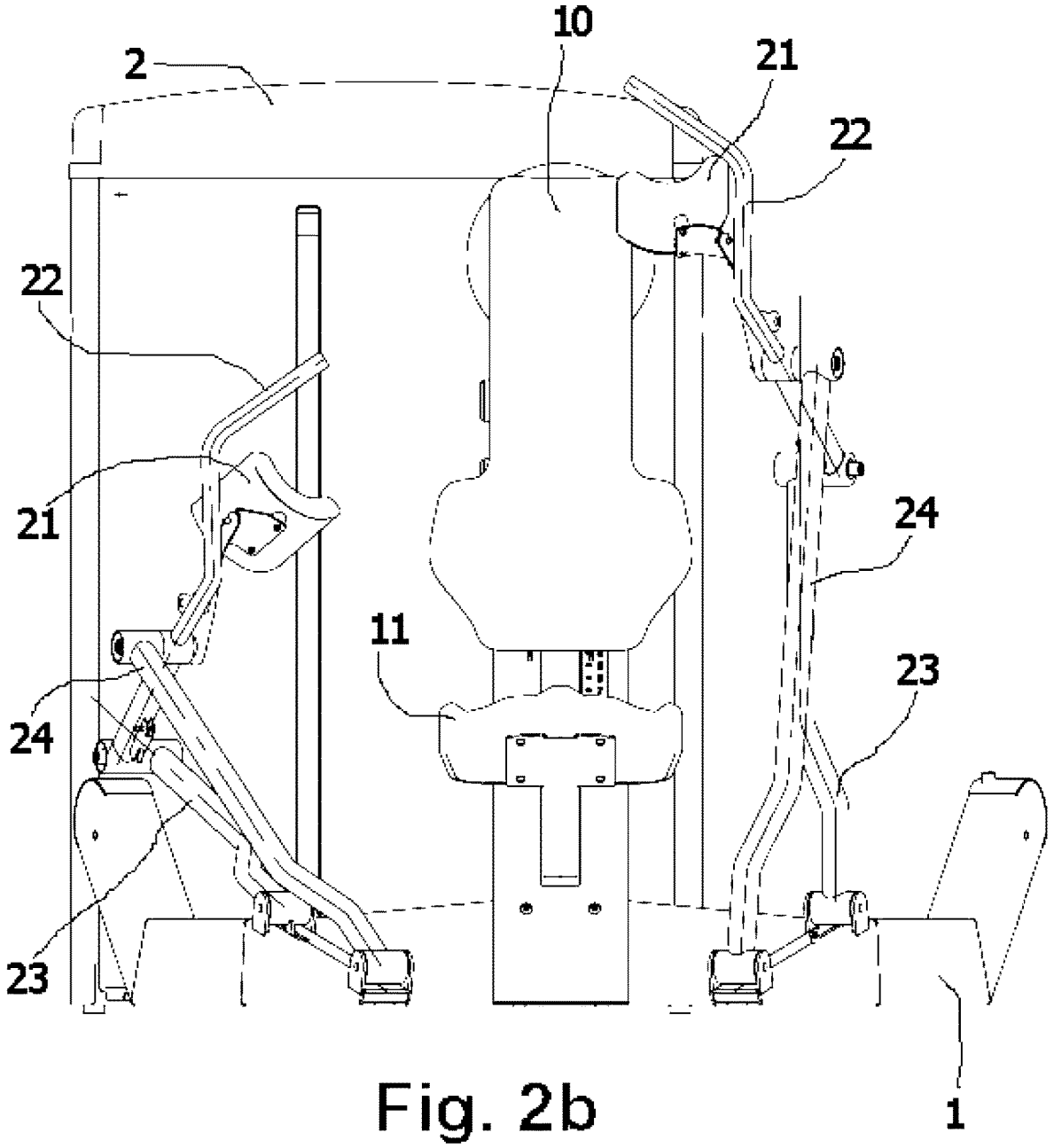
FIG. 2*b* shows a front view of the device according to the invention in the extreme position of the left hand.
Figure 2C:
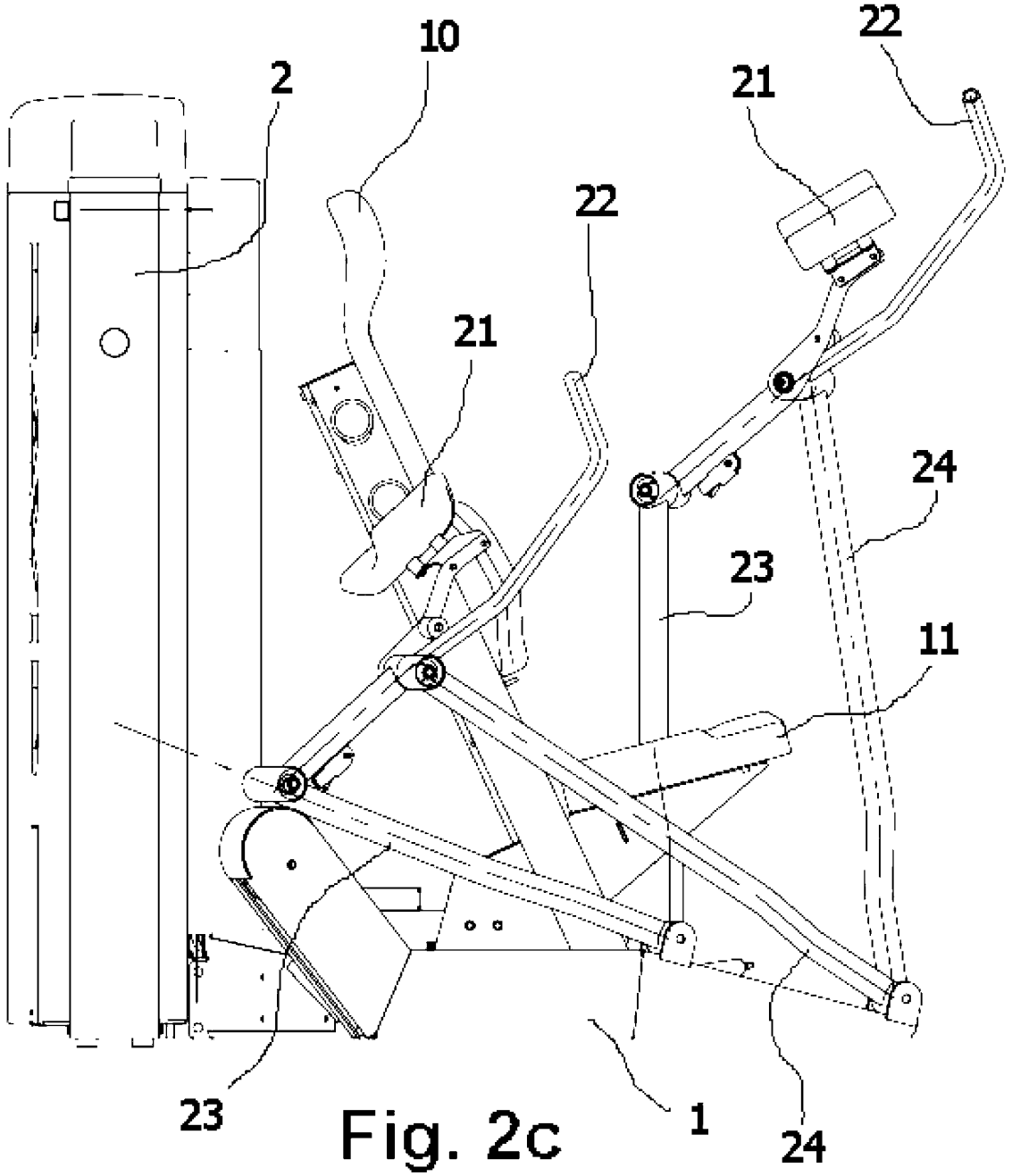
FIG. 2*c* shows a left-hand lateral view the device according to the invention in the extreme position of the left hand.
Figure 2D:
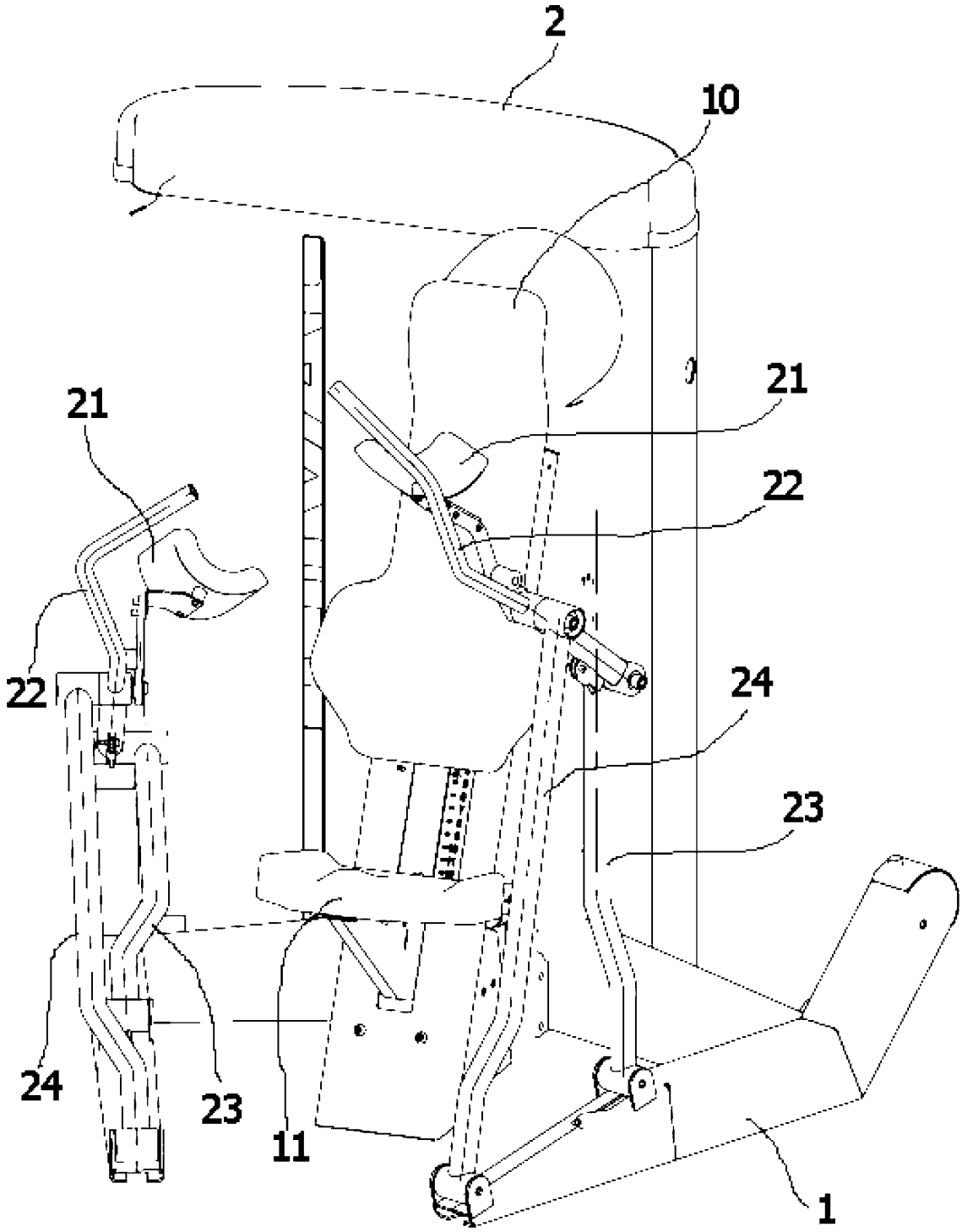
FIG. 2*d* shows a first illustrative drawing of the device according to the invention in the extreme position of the left hand.
Figure 2E:
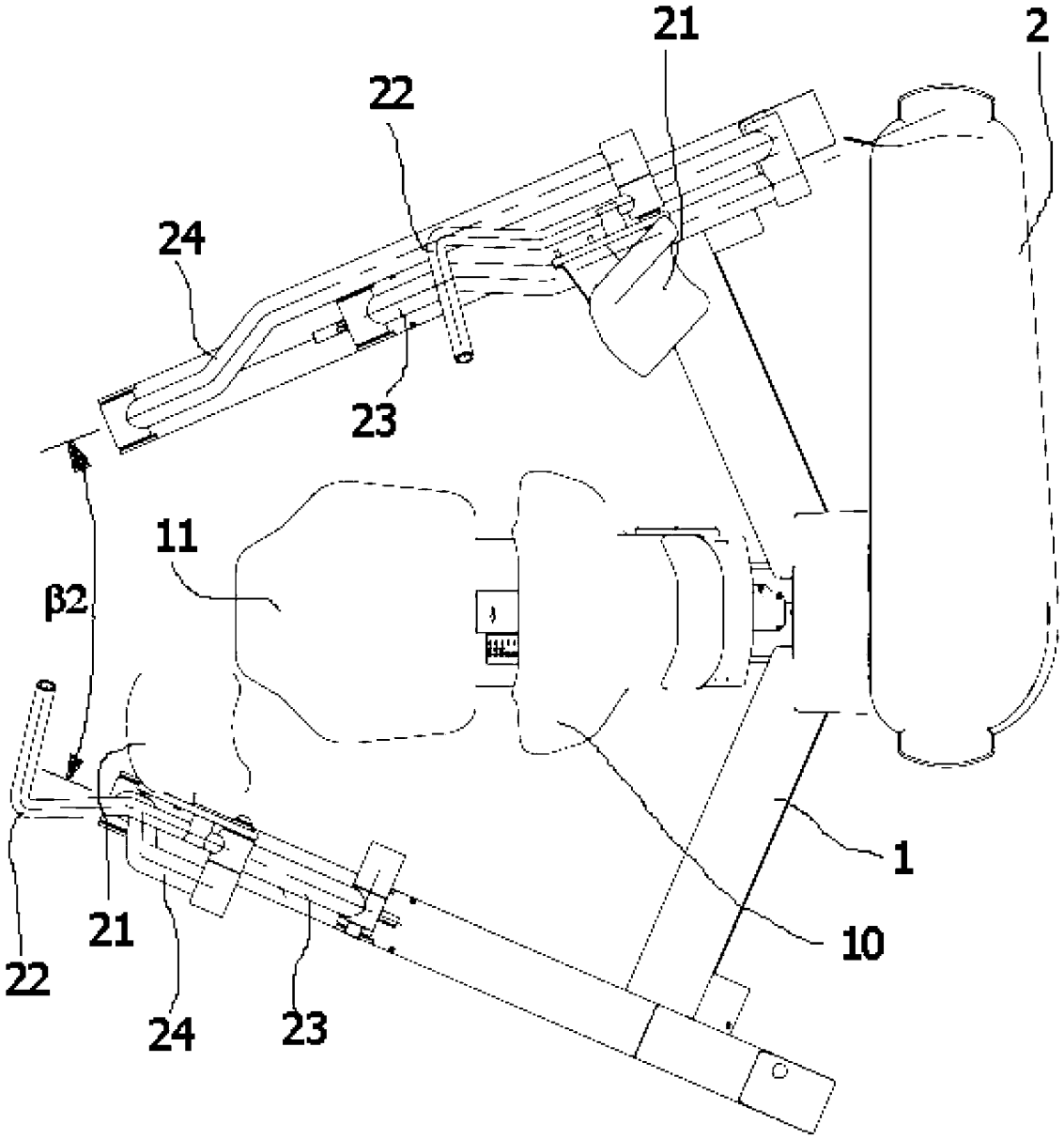
FIG. 2*e* shows a top view of the device according to the invention in the extreme position of the left hand.
Figure 2F:
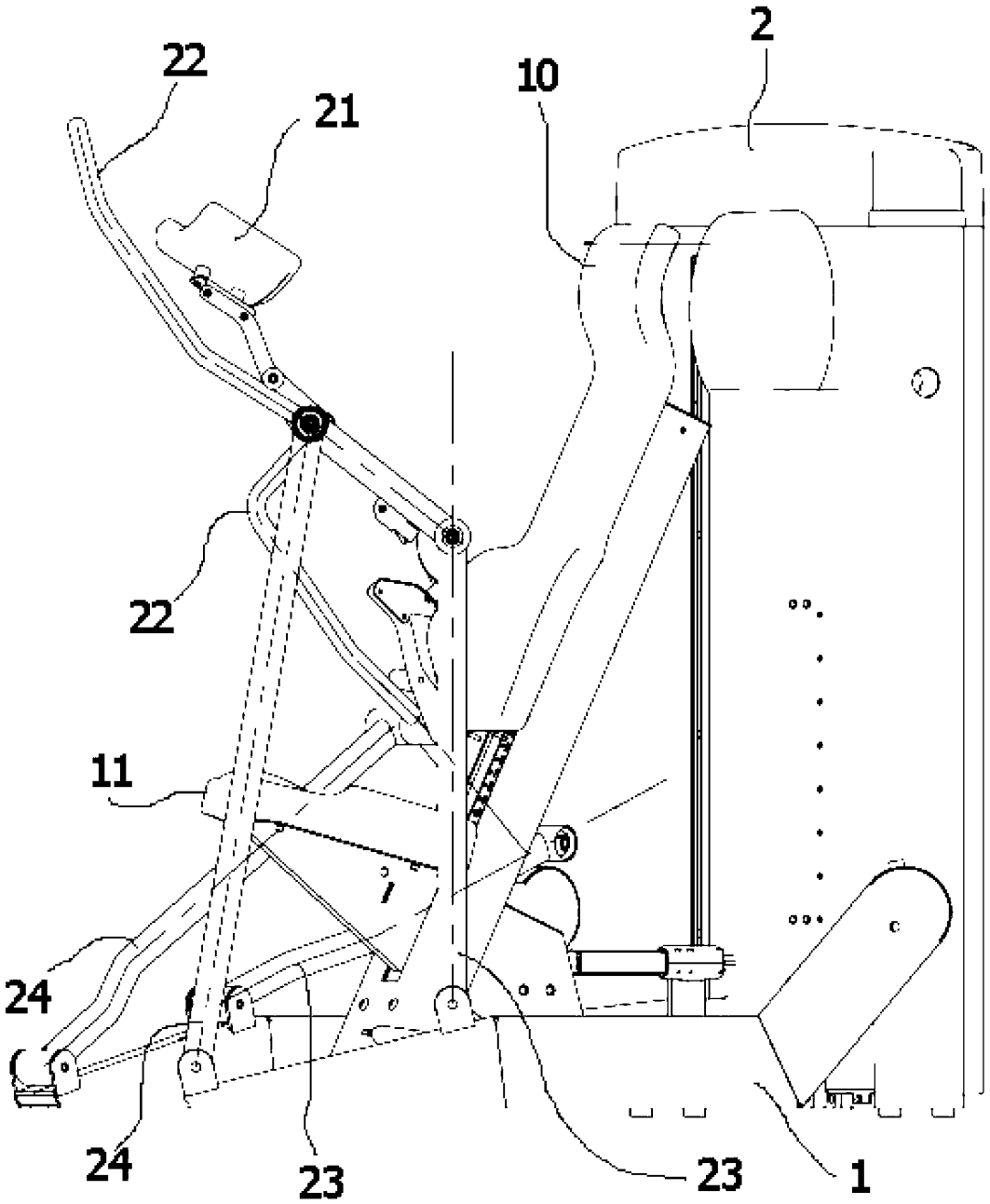
FIG. 2*f* shows a second illustrative drawing of the device according to the invention in the extreme position of the left hand.

FIGS. 2*a*-2*f* show the rehabilitation device according to the invention in the extreme and rest position. When set in the extreme position, the unit supporting the user's left arm, which consists of two support arms 23, 24, one motion arm 22 and the armrest 21, optimises the exercise of the user's anterior serratus muscle.

In the preferred embodiments of the invention, the units supporting the arms can move asynchronously between the rest position and the extreme position, as in FIGS. 2*a*-2*f*, or synchronously, so that the two lateral units reach the extreme position simultaneously, and resume the rest position simultaneously.

Figure 3B:
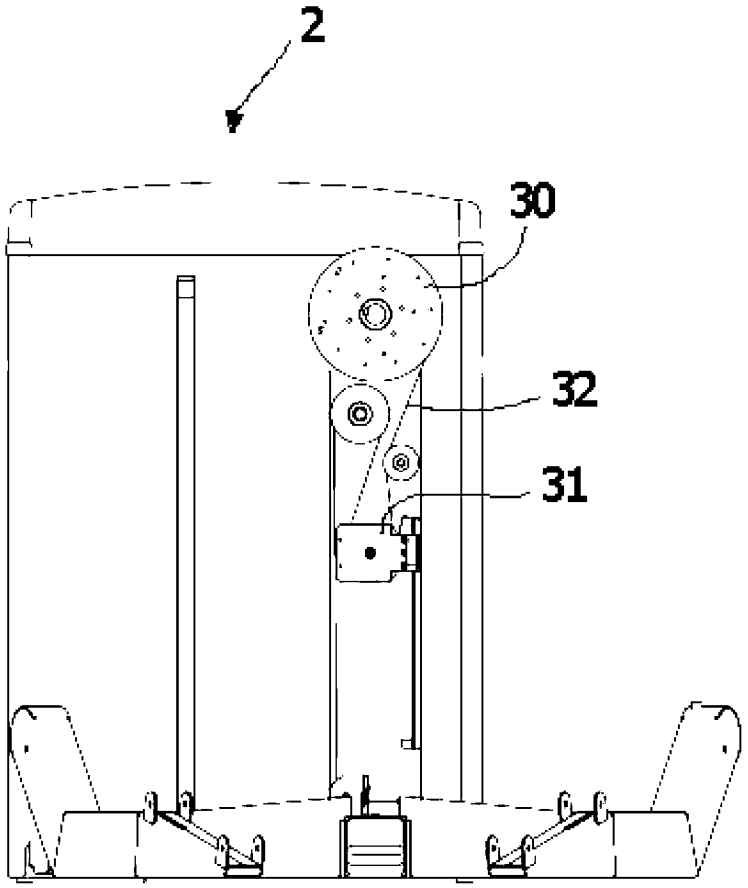
FIG. 3*b* shows a front view of the power-generating apparatus of the device according to the invention with the two motion arms pushed into the extreme position.
Figure 3A:
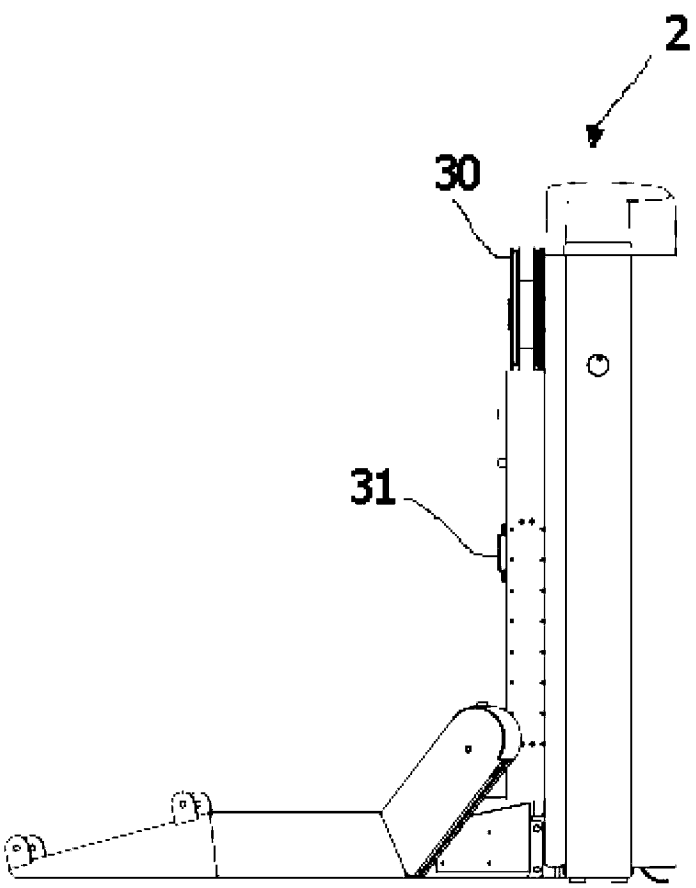
FIG. 3*a* shows a lateral view of the power-generating apparatus of the device according to the invention with the two motion arms pushed into the extreme position.
Figure 3C:
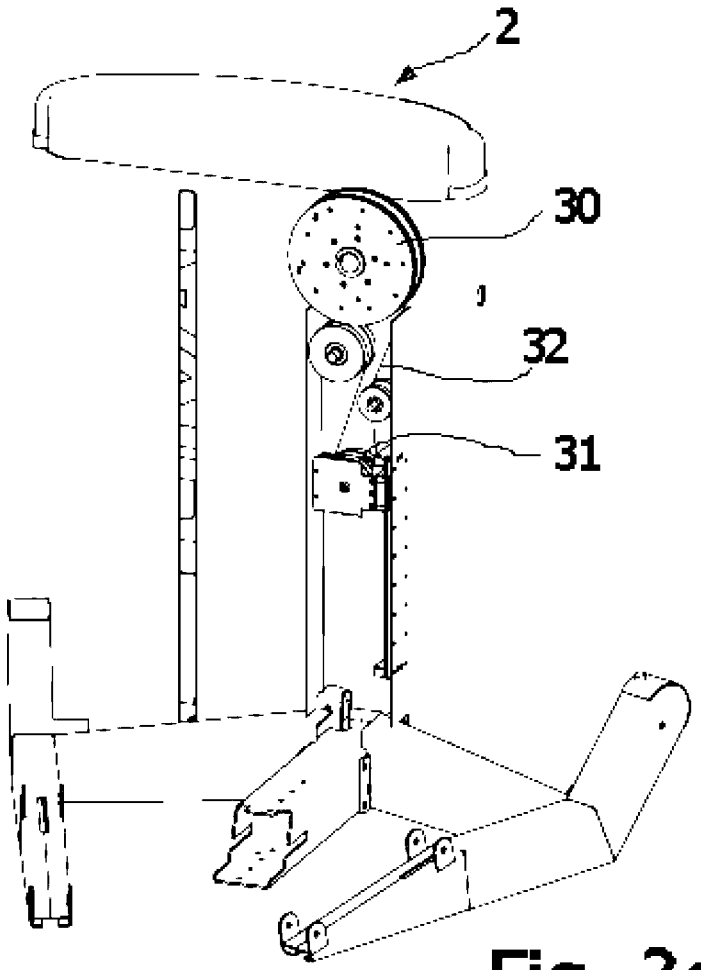
FIG. 3*c* shows an illustrative drawing of the power-generating apparatus of the device according to the invention with the two motion arms pushed into the extreme position.
Figure 3D:
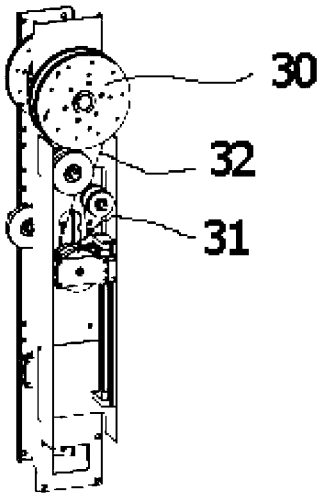
FIG. 3*d* shows a detail of the tackle gear formed by the pulleys and the cable of the power-generating apparatus of the device according to the invention, with the two motion arms pushed into the extreme position.

FIGS. 3*a*-3*d* show the trajectory of the power-transmission cable 32 through the stationary pulley 30 and the mobile pulley 31, with the two motion arms pushed into the extreme position; in this case mobile pulley 31 settles in the upper position.

Figure 4B:
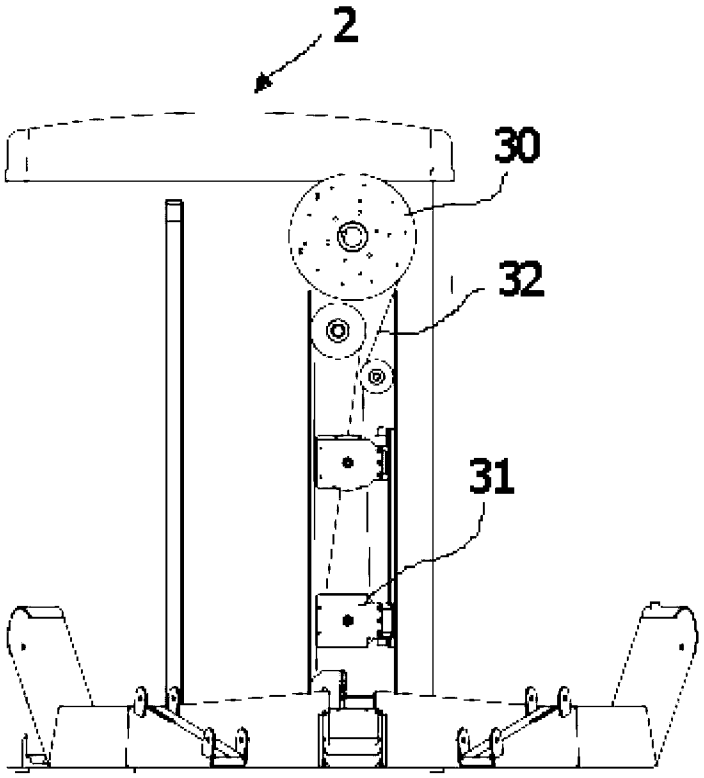
FIG. 4*b* shows a front view of the power-generating apparatus of the device according to the invention with one of the motions arms pushed into the extreme position.
Figure 4A:
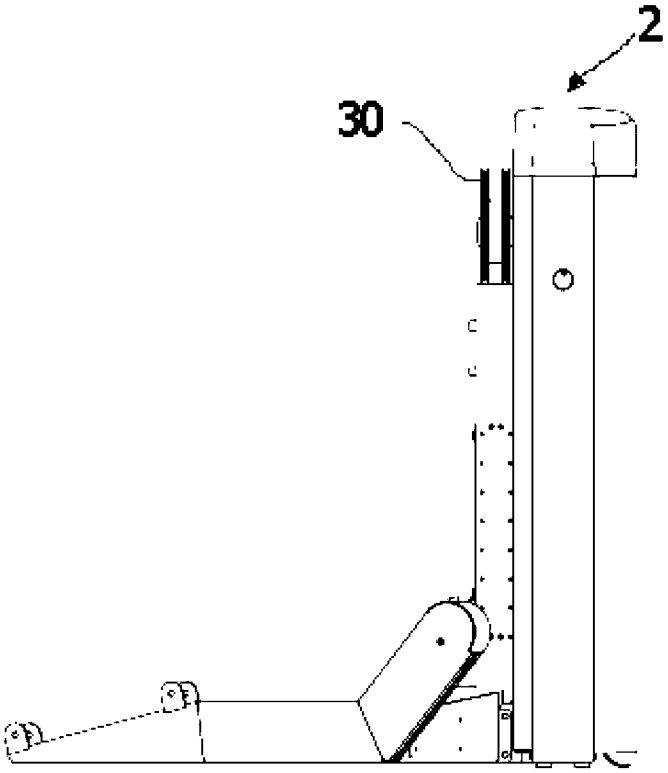
FIG. 4*a* shows a lateral view of the power-generating apparatus of the device according to the invention with one of the motions arms pushed into the extreme position.
Figure 4C:
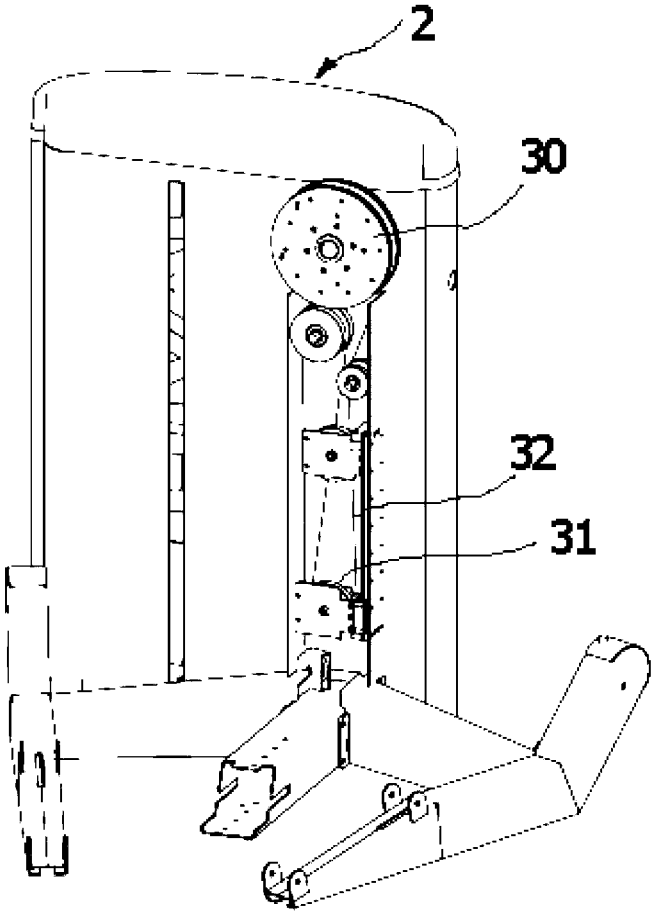
FIG. 4*c* shows an illustrative view of the power-generating apparatus of the device according to the invention with one of the motions arms pushed into the extreme position.
Figure 4D:
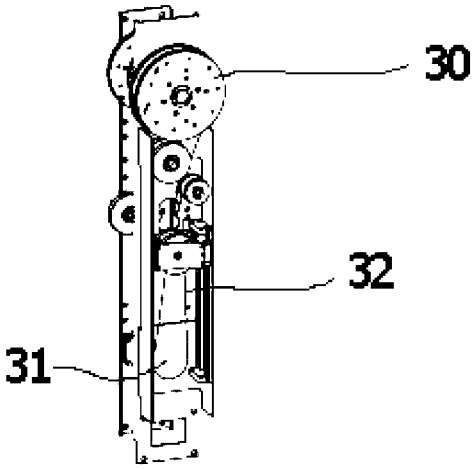
FIG. 4*d* shows a detail of the tackle gear formed by the pulleys and the cable of the power-generating apparatus of the device according to the invention, with one of the motion arms pushed into the extreme position.

FIGS. 4*a*-4*d* show the trajectory of the power-transmission cable 32 through the stationary pulley 30 and the mobile pulley 31, with one motion arm 22 pushed into the extreme position and the other motion arm 22 in the rest position. In this case, the mobile pulley 31 corresponding to the motion arm 22 in the rest position settles in the lower position.

The preferred embodiments of the device according to the invention allow controlled and safe exercise of the anterior serratus muscle. The device is bi-functional. It allows both multi-joint motion resembling bench press with extensive load on the upper body (chest press) and also a shoulder blade push-up motion directed accurately to the anterior serratus muscle. Both the exercises are optimised for rehabilitation and exercise of the shoulder joint. Both the exercises can be performed either alternately with each hand or simultaneously with both hands, so that the motion arms 22 move synchronously.

At the start of the multi-joint motion, the user's upper arm, viewed from the front, forms an angle of 50-70 degrees, preferably 55-65 degrees, more preferably 59-61 degrees, most preferably approx. 60 degrees with the body. In the final position of the motion, the upper arm, viewed laterally, forms an angle of approx. 80-100 degrees, preferably 85-95 degrees, more preferably 89-91 degrees, most preferably approx. 90 degrees with the body. Viewed from above, the motion arms 22 in different positions form mutually an angle $\beta_1$ and/or $\beta_2$, substantially of 42-52 degrees, preferably 46-48 degrees, most preferably approx. 47 degrees. Viewed laterally, the motion arm 22 and the back rest form together an angle $\alpha_1$ and/or $\alpha_2$ of substantially 88-98 degrees, preferably 92-94 degrees, most preferably approx. 93 degrees.

The seat part 11 and the back part 10 are in such a mutual angle that enables the user to be comfortably seated on the seat part while leaning on the back part. Typically, such an angle is preferably substantially approx. 100 degrees.

The power transmission of the device according to the invention is configured so that the motion arms 22 can be pre-set in a relatively forward position for shoulder blade push-up, and then the user does not need to push the motion arms 22 upwards to perform shoulder blade push-up alone. This is of particular importance at the initial stage of rehabilitation, at which large push-up motions are often forbidden. In shoulder blade push-up, bending of the elbow joint is prevented with a special armrest 21, i.e. a pad, which is articulated in the motion arm 22 with a special turn mechanism. At the same time, the armrest 21 supports the user's arm in order to minimise the "supporting" activation of the trapezial muscle. This is important, because the upper part of the trapezial muscle of shoulder patients is often hyperactive, while the activation of the anterior serratus muscle is extremely weak. The muscle activation ratio is improved in this manner.

In addition, one can aim at minimising the number of adjustments affecting the exercise position and the device parts can be automatically adjusted by an electric motor on the basis of data stored in a memory. The seat frame formed by the back part 10 and the seat part 11 is thus adjusted in the forward-backward direction and the seat part 11 in the upward-downward direction in order to obtain the optimal shoulder joint angle and exercise position.

In addition, the back part 10 of the device can be designed so as to leave space for the user's shoulder blades to move backwards. This is particularly important for the shoulder blade push-up exercise to be effective. When performing a larger multi-joint push-up, it is also important that the shoulder blades move backwards and towards one another in the initial position of the motion. If this is not the case, the shoulder bone tip will press against the front edge of the socket of the shoulder joint, and may thus cause pain and erosion in repeated exercises.

The device may comprise integrated intelligence and performance data can be collected approx. 25 times per second by means of power and angle sensors. The device allows for isometric measurements, which are expedient in diagnostics and rehabilitation monitoring.

REFERENCE NUMERALS USED IN THE FIGURES

1 frame
2 power-generating apparatus
10 back part
11 seat part
21 armrest
22 motion arm
23 first support arm
24 second support arm
30 stationary pulley
31 mobile pulley
32 power transmission cable
$\alpha_1$ angle between the motion arm and the backrest in the rest position
$\alpha_2$ angle between the motion arm and the backrest in the extreme position
$\beta_1$ angle between the motion arms in the rest position
$\beta_2$ angle between the motion arms in the extreme position

The invention claimed is:

1. A rehabilitation device adapted for rehabilitation and/or exercise of the shoulder region, the device being provided with a frame (1), which is connected to
- a power-generating apparatus (2);
- a back part (10);
- a seat part (11); and
- armrests (21);

characterised in that the rehabilitation device further comprises
- first support arms (23);
- second support arms (24); and
- motion arms (22), which communicate with said corresponding first and second support arms;

and in that
- said armrests (21) are connected to said corresponding motion arms (22); and
- said power-generating apparatus (2) communicates with said motion arms (22)

wherein the predetermined trajectory of the armrests is such that the motion arms (22) form mutually an angle $\beta_1$ and/or $\beta_2$ of 42-52 degrees viewed from above and each motion arm (22) and the back rest form together an angle $\alpha_1$ and/or $\alpha_2$ of 88-98 degrees viewed laterally.

2. The rehabilitation device according to claim 1, in which each armrest (21) is movably supported by the corresponding motion arm (22) and the corresponding support arms (23, 24) over a predetermined trajectory.

3. The rehabilitation device according to claim 2, in which said trajectory passes from a rest position to an extreme position and vice versa.

4. The rehabilitation device according to claim 3, in which the armrests (21) can be moved synchronously or asynchronously relative to one another.

5. The rehabilitation device according to claim 3, in which the power-generating apparatus (2) comprises a pulley (31), which can be moved so as to vary the power generated.

6. The rehabilitation device according to claim 3, further comprising a means for transmitting stored data to the power-generating apparatus, and also means for automatic adjustment of at least one of the following on the basis of the stored data: the armrests (21), the motion arms (22), the support arms (23, 24), the back part (10), the seat part (11), the power-generating apparatus (2).

7. The rehabilitation device according to claim 6, in which data are stored in a cloud service and/or contain the personal data of each user for adjusting the device.

8. The rehabilitation device according to claim 3, which is adapted to activate the anterior serratus muscle (m. serratus anterior).

9. The rehabilitation device according to claim 2, in which the armrests (21) can be moved synchronously or asynchronously relative to one another.

10. The rehabilitation device according to claim 2, in which the power-generating apparatus (2) comprises a pulley (31), which can be moved so as to vary the power generated.

11. The rehabilitation device according to claim 2, further comprising a means for transmitting stored data to the power-generating apparatus, and also means for automatic adjustment of at least one of the following on the basis of the stored data: the armrests (21), the motion arms (22), the support arms (23, 24), the back part (10), the seat part (11), the power-generating apparatus (2).

12. The rehabilitation device according to claim 11, in which data are stored in a cloud service and/or contain the personal data of each user for adjusting the device.

13. The rehabilitation device according to claim 2, which is adapted to activate the anterior serratus muscle (m. serratus anterior).

14. The rehabilitation device according to claim 1, in which the armrests (21) can be moved synchronously or asynchronously relative to one another.

15. The rehabilitation device according to claim 1, in which the power-generating apparatus (2) comprises a pulley (31), which can be moved so as to vary the power generated.

16. The rehabilitation device according to claim 1, further comprising a means for transmitting stored data to the power-generating apparatus, and also means for automatic adjustment of at least one of the following on the basis of the stored data: the armrests (21), the motion arms (22), the support arms (23, 24), the back part (10), the seat part (11), the power-generating apparatus (2).

17. The rehabilitation device according to claim 16, in which data are stored in a cloud service and/or contain the personal data of each user for adjusting the device.

18. The rehabilitation device according to claim 1, which is adapted to activate the anterior serratus muscle (m. serratus anterior).

19. A method of using the rehabilitation device according to claim 1, said method comprising the user positioning the arms in the armrests (21) and moving one or both arms between the rest position and the extreme position over a predetermined trajectory, while the armrests (21) support the user's arms wherein the predetermined trajectory of the motion arms is such that the motion arms (22) form mutually an angle $\beta_1$ and/or $\beta_2$ of 42-52 degrees viewed from above and each motion arm (22) and the back rest form together an angle $\alpha_1$ and/or $\alpha_2$ of 88-98 degrees viewed laterally so as to minimise the activation supporting the upper part of the trapezius muscle.

* * * * *